United States Patent [19]

Tanimura et al.

[11] Patent Number: 4,928,562

[45] Date of Patent: May 29, 1990

[54] FILM PERFORATOR

[75] Inventors: Toyokiti Tanimura, Akishima; Masahiro Ikeda, Tama, both of Japan

[73] Assignee: Konica Corporation, Tokyo, Japan

[21] Appl. No.: 340,349

[22] Filed: Apr. 19, 1989

[30] Foreign Application Priority Data

Apr. 20, 1988 [JP] Japan ..... 63-97955

[51] Int. Cl.[5] ..... B26F 1/02

[52] U.S. Cl. ..... 83/278; 23/33; 23/133; 23/110; 23/276

[58] Field of Search ..... 83/278, 276, 213, 618, 83/202, 420, 423, 133, 135, 33, 110, 18, 176

[56] References Cited

U.S. PATENT DOCUMENTS 1,291,524 1/1919 Howell ..... 83/278 X 1,416,168 5/1922 Carleton ..... 83/278 X

*Primary Examiner*—Donald R. Schran

*Attorney, Agent, or Firm*—Finnegan, Henderson, Farabow, Garrett and Dunner

[57] ABSTRACT

Disclosed is a film perforator having a punch unit, a pad roller and a feed roller which are disposed at the upstream side of the punch unit and support a film by nipping it between them, and a sprocket which is disposed at the downstream side of the punch unit and comes into engagement with punch-finished perforations, the sprocket and the feed rollers are connected by a pulley and the line speed of the sprocket is adjsuted to be a little higher than that of the feed rollers so that the film is caused to slip from its nipped position between the feed roller and the pad roller, whereby the film is exerted with backward tension so as to keep its proper flatness.

5 Claims, 2 Drawing Sheets

FILM PERFORATOR

BACKGROUND OF THE INVENTION

The present invention relates to a film perforator that can transport a film stably at a high speed.

In the conventional film perforator as shown in FIG. 3A, film 2 delivered from supply reel 1 is supported by being nipped between feed roller 3 and pad roller 3, and is supplied to punch unit 5 through guide chute 4. Film 2 is perforated by punching at punch unit 5, thereafter proceeds through sprocket 6 which comes into engagement with the perforations, side mark printer 7 and second sprocket 8 in order, and is then reeled up by take-up reel 9. As shown in FIG. 3B, when film 2 passes through punch unit 5, film 2 is transported at high speed between stripper 5*c* and die 5*d* while punches 5*a* and pilots 5*b* are moving upward. In this case, since the space l between stripper 5*c* and die 5*d* is quite narrow (about 1.0 mm to 1.3 mm), if film 2 is not exerted with sufficient tension so as to keep its proper flatness or stiffness, film may touch stripper 5*c* or die 5*d* while being conveyed, creating scratches or static electricity. In order to keep film 2 taut, in the above conventional apparatus, there is incorporated means 2' for providing film 2 with backward tension. Specifically, a predetermined tension is achieved by using a vacuum pump or a blower, or dancer roller, which is not shown in FIG. 3*a*.

However, the above means for tensioning to the film is complicated in structure and needs a large installation space. Additionally, there is a problem that it is difficult to convey the film stably at high speed.

SUMMARY OF THE INVENTION

It is an object of this invention to solve these problems, by providing a film perforator of a simple construction which may transport the film at high speed in synchronization with film perforation speed while keeping proper tension of the film.

Another object of the invention is to provide a film perforator which does not cause any scratches or static electricity to the film's surface during the film's passage.

To achieve the above objects, according to the invention, a film perforator comprises a punch unit, a pad roller and a feed roller which are disposed at the upstream side of the punch unit and support a film by nipping it between them. A sprocket which is disposed at the downstream side of the punch unit comes into engagement with punch-finished perforations. The sprocket and the feed rollers are connected by a pulley and the line speed of the sprocket is adjusted to be a little higher than that of the feed rollers so that the film is caused to slip from its nipped position between the feed roller and the pad roller, whereby the film is exerted with backward tension so as to keep its proper flatness. It is preferable to set the slip ratio within a range of 0.075 to 7.5% so as not to damage the photosensitive surface of the film. Furthermore, the nipped positions of the both rollers are arranged not to deform so that high speed transportation of the film can be attained.

The accompanying drawings, of the present invention which are incorporated in and constitute a part of this specification, illustrate several embodiments of the present invention and together with the description, serve to explain the principles of the present invention.

FIG, 2 is a cross sectional view of the guide chute; and

Figure 3A:
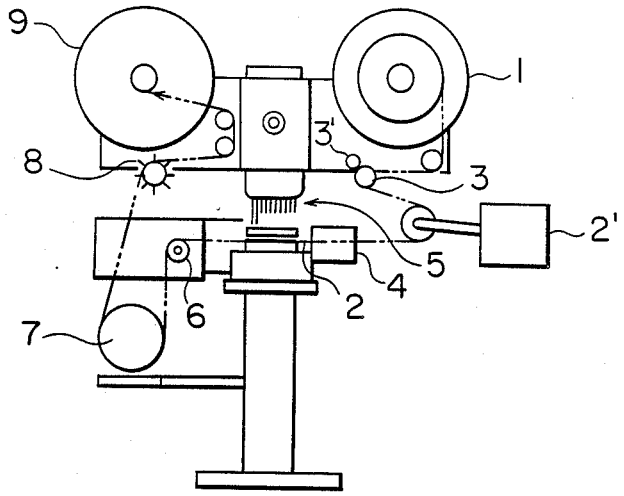
Figure 3B:
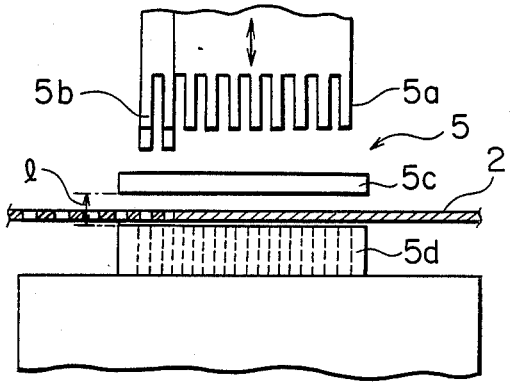

FIGS. 3 A and B are side and cross sectional views respectively of a conventional apparatus.

DETAILED DESCRIPTION OF THE INVENTION

Figure 1:
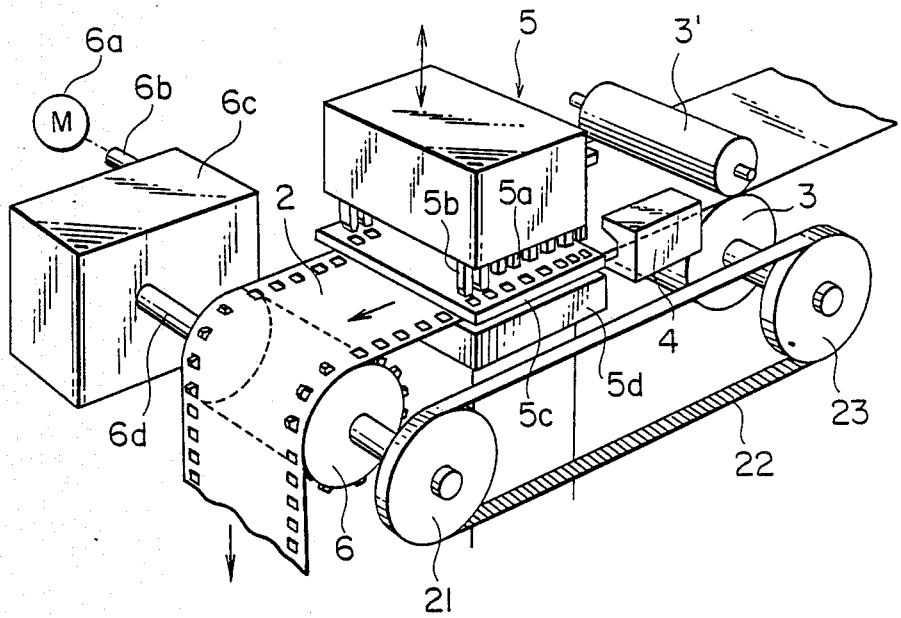
FIG. 1 is a perspective view of the film perforator of the present invention.
Figure 2:
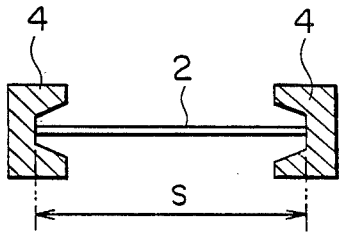

The present invention will be explained based on the examples shown in FIGS. 1 and 2. The parts shown in FIG. 3 are represented by the same numerals in FIGS. 1 and 2.

Sprocket 6 for pulling film 2 from stripper 5*c* and die 5*d* of punch unit 5 is coupled with output shaft 6*d* of index device 6*c* which converts a given speed rotation of input shaft 6*b* connected to driving source 6*a* and outputs an converted intermittent rotation per a designated angle.

Feed roller 3 for feeding film 2 to punch unit 5 is coupled with sprocket 6 through timing pulley 21, timing belt 22 and timing pulley 23, so that feed roller 3 is able to convey film 2 in synchronization with sprocket 6. In this case, the line speed of sprocket 6 is adjusted to be a little higher than that of feed roller 3. Changing the radii of timing pulleys 21 and 23 makes this adjustment possible. During a stoppage of film 2, a ram equipped with punches 5*a* and pilots 5*b* comes down. After the ram punches perforations into film 2, while punches 5*a* and pilots 5*b* are going up, film 2 is transported in the arrowed direction by driving sprocket 6 and by driving feed roller 3 in synchronization with sprocket 6. During this film transportation, corresponding to the speed difference between sprocket 6 and feed roller 3, film 2 nipped between feed roller 3 and pad roller 3' is caused to slip so that film 2 is exerted with backward tension to keep it taut.

It is necessary to avoid damaging the photosensitive surface of the film caused by the above slippage. Accordingly, it is important to adjust the speed of feed roller 3 and pad roller 3' slower than that of sprocket 6 so as to make slip ratio within the range of 0.075 to 7.5%. The slip ratio is calculated by dividing the difference between the speeds of sprocket 6 and feed roller 3 by the speed of sprocket 6.

In order to convey the film as rapidly as possible, it is necessary to avoid the generation of static electricity on the film surface caused by friction when the film is slipping between feed roller 3 and pad roller 3'. To avoid the above static electricity, both feed roller 3 and pad roller 3' are made of conductive rubber rollers and the hardness of rubber is made to be lower that 50 degrees so as not to cause the nipping positions of the rollers to deform.

Furthermore, in order to convey the film at a high speed, the nipping pressure (considered as linear contact) between feed roller 3 and pad roller 3' may preferably to be not larger than 120 g/mm. Additionally, in guide chutes 4 for giving side pressure to both side edges of film 2 as shown in FIG. 2, the distance S between guide pieces is preferably to set at 34.98 mm equal to the width size of the film. The guide chutes 4 not only to prevent widthwise movement of the film, they also are effective for the high speed transportation. Guide chutes 4 further act to suppress motive energy to stop the film. However, if guide chutes 4 are arranged so as to prevent only widthwise movement of the film as mentioned above, the work for suppressing motive energy becomes ineffective. Consequently, it is preferably to consider that the abovementioned pad roller may be so arranged to couple with a powder limiter so that an inertia taking place when stopping the film is effectively suppressed and the film is stopped accurately at a desired position.

As mentioned above, according to the invention, a film perforator comprises a sprocket which comes into engagement with punch-finished perforations at the downstream side of a punch unit, a pad roller and a feed roller which support a film by nipping it between them at the upstream side of the punch unit, the foregoing sprocket and feed rollers are connected by a pulley and the line velocity of the sprocket is adjusted to be slightly higher than that of the feed roller. By this method, the structure of the mechanism for keeping the film flat under tension becomes very simple and is made to be compact. Therefore, it is not necessary to use a vacuum pump or blower in order to provide backward tension to the film, or to use a dancer roller as in the conventional way.

Also, accordidng to the invention, since the feed roller nipping the film slips around 0.075% to 7.5% in relation to the film transported by the sprocket, there is no slack causing the film to be damaged.

Furthermore, since the feed roller and the pad roller nipping the film therebetween are made of rubber with a hardness of not more than 50 degrees, the nipping positions of the rollers are not deformed, whereby the film can be conveyed at a high speed.

Other embodiments of the present invention will be apparent to those skilled in the art from consideration of the specification and practice of the disclosed invention. The specification and examples are intended to be exemplary only, with the true scope and spirit of the invention being represented by the following claims.

What is claimed is:

1. An apparatus for perforating a photographic film comprising:

perforation means for perforating the film;

a feed roller and a pad roller for nipping the film therebetween and feeding the film at a high speed to the perforation means;

means for advancing the film from the perforation means, the advancing means comprising a sprocket for engagement with the film perforations, the sprocket being coupled to the feed roller for conveying the film in synchronization with the sprocket, and the advancing means including means for maintaining the speed of the sprocket higher than the speed of the feed roller for producing a backward tension on the film.

2. The apparatus according to claim 1 wherein the feed roller and pad roller each includes a nipping surface for allowing the film to slip with relation to the feed roller by about 0.075 to 7.5%.

3. The apparatus according to claim 1 wherein the feed roller and pad roller each include a rubber material having a hardness sufficient to resist deformation and inhibit static electricity as the film is transported.

4. The apparatus according to claim 1 wherein the perforation means comprises a movable ram including punches and pilots, for perforationg the film when the film is at a standstill and for driving the film by the feed roll and sprocket when the ram is moved away from the film.

5. The apparatus of claim 1 wherein the speed maintaining means includes at least two timing pulleys and a timing belt.

* * * * *